US005439011A

United States Patent [19]

Schneider

[11] Patent Number: 5,439,011

[45] Date of Patent: Aug. 8, 1995

[54] COAXIAL FILTER CIGARETTE

[75] Inventor: Werner Schneider, Quickborn, Germany

[73] Assignee: B.A.T. Cigarettenfabriken GmbH, Hamburg, Germany

[21] Appl. No.: 255,981

[22] Filed: Jun. 8, 1994

[30] Foreign Application Priority Data

Jun. 24, 1993 [DE] Germany ..... 43 21 069.4

[51] Int. Cl.[6] ..... A24D 1/04

[52] U.S. Cl. ..... 131/360; 131/336; 131/338; 131/344

[58] Field of Search ..... 131/360, 364, 336, 338, 131/339, 341, 344

[56] References Cited

U.S. PATENT DOCUMENTS

| | | | |
|---|---|---|---|
| 3,359,988 | 12/1967 | Thomson | 131/338 X |
| 3,756,250 | 9/1973 | Morgenstern | 131/339 X |
| 4,649,941 | 3/1987 | Norman et al. | 131/339 X |
| 4,649,945 | 3/1987 | Norman et al. | 131/338 X |
| 4,658,838 | 4/1987 | Leonard | 131/338 X |
| 4,776,354 | 10/1994 | Norman et al. | 131/336 |
| 4,874,004 | 10/1990 | Borowski et al. | 131/364 |
| 4,986,287 | 1/1991 | Schneider et al. | 131/360 |

FOREIGN PATENT DOCUMENTS

| | | |
|---|---|---|
| 874119 | 4/1953 | Germany . |
| 3743597C1 | 2/1989 | Germany . |
| 3901226C1 | 7/1990 | Germany . |
| 451789 | 5/1968 | Switzerland . |

*Primary Examiner*—Jennifer Bahr
*Attorney, Agent, or Firm*—Armstrong, Westerman Hattori, McLeland & Naughton

[57] ABSTRACT

The coaxial filter cigarette according to the invention contains of a coaxial rod portion and a coaxial filter element. The rod portion contains an inner core of a material glowing or smouldering substantially residue-free, in particular tobacco material, which is surrounded by a wrapper which in turn is surrounded by an outer jacket of a tobacco and/or non-tobacco material. A wrapper of an air-permeable material surrounds the outer jacket. The coaxial filter element has a filter core with an air-impermeable wrapper. A filter jacket having a diameter corresponding to the diameter of the outer jacket coaxially surrounds the filter core and its wrapper. An air-impermeable wrapper serving also to connect the rod portion and filter element surrounds the filter jacket. A ventilation zone is worked into the air-impermeable wrapper for the filter jacket. In the transition region between the rod portion and the filter element a smoke mixing zone is formed for defined variation of the smoke mixture leaving the rod portion before it flows into the filter element.

9 Claims, 2 Drawing Sheets

FIG.1
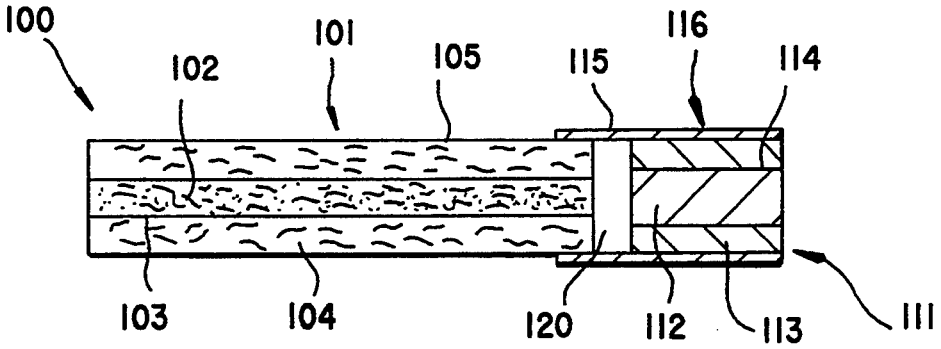
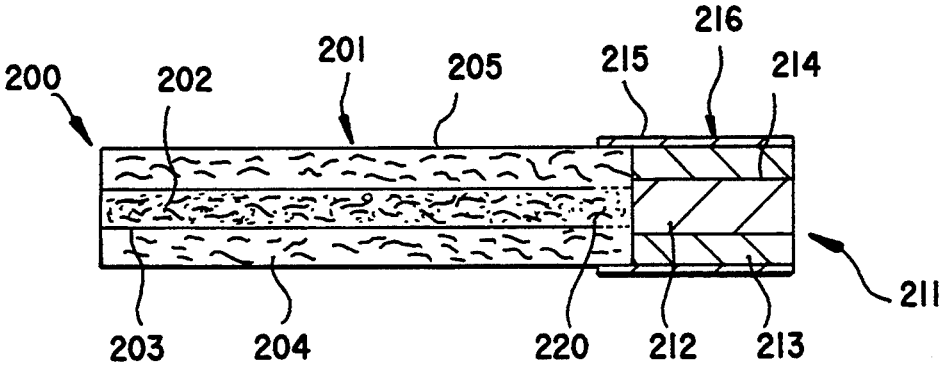
FIG.2

FIG.3
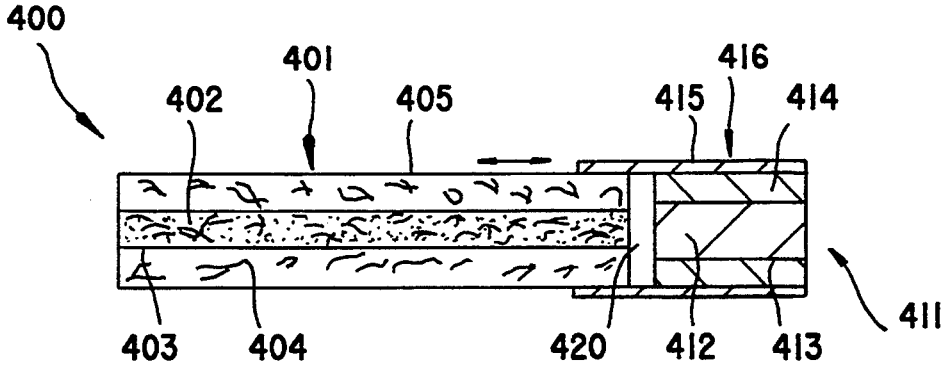
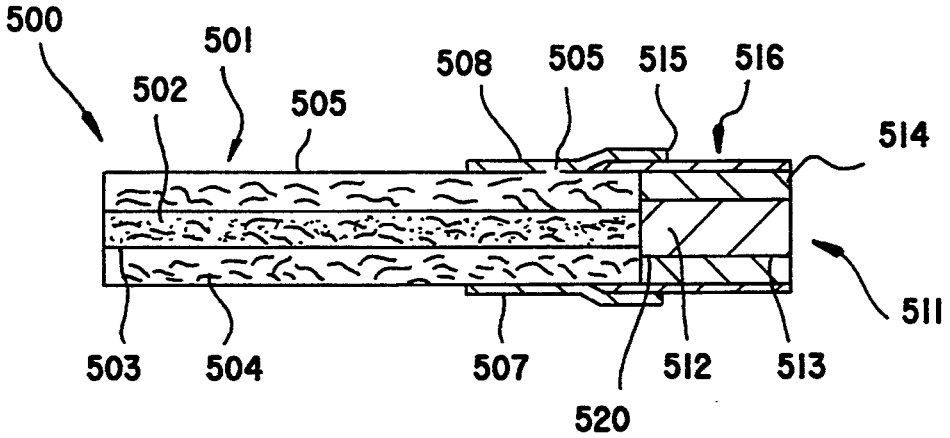
FIG.4

COAXIAL FILTER CIGARETTE

BACKGROUND OF THE INVENTION

1. Field of the Invention

The invention relates to a coaxial filter cigarette comprising a coaxial rod portion having an inner core of a material smouldering substantially residue-free, in particular tobacco material, a wrapper for the inner core, an outer jacket consisting of a tobacco and/or non-tobacco material and coaxially surrounding the inner core and its wrapper, and an air-permeable wrapper for the outer jacket, and comprising a coaxial filter element having a filter core having an air-impermeable wrapper, a filter jacket coaxially surrounding the filter core and its wrapper and having a diameter corresponding to the diameter of the outer jacket, an air-impermeable wrapper for the filter jacket serving also to connect the rod portion and the filter element, and a ventilation zone in the air-impermeable wrapper for the filter jacket.

2. Description of the Prior Art

Coaxial filter cigarettes are known from German (DE) patent 3,901,228 and German (DE) patent 3,743,597.

The coaxial filter cigarette according to patent DE 3,901,226 is a cigarette having a rod portion comprising an inner core of a material smouldering substantially residue-free, in particular tobacco material, a wrapper for the inner core, an outer jacket coaxially surrounding the inner core and its wrapper and consisting of a tobacco and/or non-tobacco material, and a wrapper for the outer jacket, as well as a filter portion having a filter core, an air-impermeable wrapper for the filter core, a filter jacket and a wrapper for the filter jacket. This coaxial filter cigarette comprises a zone of the main heat source which is located in the inner core of the rod portion, and a zone in which the major part of the aerosol reaching the mouth of the smoker is generated and which is disposed in the outer jacket of the rod portion; the filter portion appreciably reduces the combustion gases originating from the inner core of the rod portion and substantially diminishes the smoke particles originating from the inner core, whilst the aerosol generated in the outer jacket of the rod portion is only slightly influenced or not at all.

Patent specification DE 3,743,597 discloses a coaxial cigarette having a tobacco rod comprising an inner core of a material which glows substantially residue-free, in particular tobacco material. This coaxial cigarette comprises a wrapper for the inner core, an outer jacket of a tobacco and/or non-tobacco material coaxially surrounding the inner core or its wrapper and a wrapper for the outer jacket. It comprises a ventilated coaxial filter having a filter core, the inner diameter of which corresponds substantially to the diameter of the inner core, and a filter jacket; the filter core has an air-impermeable wrapper; the filter jacket has an air-permeable wrapper; the wrapper of the inner core and the wrapper of the outer jacket are provided with glow salts; and the draw resistance of the inner core is lower than the draw resistance of the outer jacket.

The prior art as disclosed for example from German patent DE 3,901,226 has the objective of avoiding any appreciable mixing of the smokes from the inner core and the outer jacket of the rod portion and does not provide any possibility of different mixing degrees of the two smoke components from the tobacco rod. A further disadvantage of the subject of the aforementioned patent specification is that a variation of the smoke mixing degree with regard to the flavour character or the value level cannot be effected by the smoker.

The cigarette according to patent specification DE 3,743,597 has similar objectives to the cigarette according to patent specification DE 3,901,226.

SUMMARY OF THE INVENTION

The invention therefore has as its object the provision of a coaxial cigarette aiming at different objectives. In particular, a filter cigarette of the type indicated is proposed which permits further flavour variations from one tobacco mixture.

The invention therefore proposes in a coaxial cigarette comprising a coaxial rod portion having an inner core of a material smouldering substantially residue-free, in particular tobacco material, a wrapper for the inner core, an outer jacket consisting of a tobacco and/or non-tobacco material and coaxially surrounding the inner core and its outer jacket, and an air-permeable wrapper for the outer jacket, and comprising a coaxial filter element having a filter core having an air-impermeable wrapper, a filter jacket coaxially surrounding the filter core and its wrapper and having a diameter corresponding to the diameter of the outer jacket, an air-impermeable wrapper for the filter jacket serving also to connect the rod portion and the filter element, and a ventilation zone in the air-impermeable wrapper for the filter jacket, the improvement comprising the following features: in the transition region between the rod portion and the filter element a smoke mixing zone is formed for defined variation of the smoke streams leaving the rod portion before they flow into the filter element.

Expedient embodiments are defined by the features of the subsidiary claims.

A substantial advantage of the coaxial cigarette according to the invention resides in that different admixing degrees of two different smokes from the rod portion of the cigarette can be implemented. The differences in the smokes of the rod portions are due to the different blend, flavour and casing components in the outer jacket of the rod portion and in the inner core of the rod portion. In a coaxial cigarette according to the present invention a smoke mixture is formed which is greatly different from the smoke streams of coaxial cigarettes according to the prior art. With the smoke mixing zone provided, the smoke mixing degree can be varied within a wide range by technically simply implementable design variations. The following can be set forth as examples of technically simply implementable design variations for varying the smoke mixing degree:

- creation of perforations (electrostatically or by laser) at the filter-side end of the rod portion,
- use of cigarette paper with different air permeability,
- relatively slight variation of the specific rod draw resistances of the core and jacket in such a manner that the ratio of the specific tobacco rod draw resistances is appreciably changed by tobacco preparations and/or by varying the packing density.

Special versions which will be explained in detail later in the description of the figures permit variations of the smoke mixing degree adjustable by the smoker and thus a possibility of selecting a) the flavour character of different mixtures and/or
b) the value level.

A further substantial advantage of the coaxial filter cigarette according to the present invention is the possible transfer of volatile aroma components from one of the two smoke streams separate over the major part of the rod portion to the other smoke stream without an appreciable amount of the undesired non-volatile or sparingly volatile components being transferred as well. Thus, for example, in the inner core of the rod portion Burley flavour grades may be located whereas in the periphery no Burley grades at all are contained, but for example flue cured grades and/or tobacco sheet, in particular also extracted sheet. On the other hand, in the outer jacket of the rod portion relatively high concentrations of volatile flavour and/or casing components may be present which are not contained in the inner core. These volatile flavour and/or casing components may be partially mixed with the smoke from the inner core and thereby produce specific flavour impressions.

The smoker has a further possibility of adapting the flavour impression to his wishes by partial covering of a perforation zone in the filter-side portion of the wrapper of the outer jacket of the rod portion by means of a rotatable or displaceable ring, which may also have ventilation zones, or by variation of the length of the smoke mixing zone.

BRIEF DESCRIPTION OF THE DRAWINGS

The invention will be described in more detail hereinafter with reference to examples of embodiment with the aid of the attached schematic drawings, wherein:

FIG. 1 is an axial section through a coaxial filter cigarette having a mixing chamber between the rod portion and the filter element, FIG. 2 is an axial section through a coaxial cigarette having a smoke mixing zone at the tobacco-side end of the rod portion, the smoke mixing being obtained by a perforation zone in the wrapper for the inner core at the filter-side end of the rod portion, FIG. 3 is an axial section through a coaxial filter cigarette corresponding to FIG. 1, in which however the rod portion can be displaced in the axial direction within defined markings on the wrapper of the outer jacket, and FIG. 4 is an axial section through a coaxial filter cigarette, the filter and/or rod portion of which is provided with a rotatable or displaceable ring which may be locally perforated so that by turning or displacing the ring the smoke pattern of the cigarette can be set by the smoker.

DESCRIPTION OF THE PREFERRED EMBODIMENTS

FIG. 1 shows a coaxial cigarette, denoted generally by the reference numeral 100, having a coaxial rod portion and a coaxial filter element 111. The rod portion has an inner core 102 of a material which glows substantially residue-free, in particular tobacco material, with an air-impermeable or sparingly porous wrapper 103. The air-permeability of this wrapper 103 is at the most 50 ISO units. An outer jacket 104 of a tobacco and/or non-tobacco material coaxially surrounds the inner core 102 and its wrapper 103. The outer jacket 104 is surrounded by an air-permeable wrapper 105, the latter generally being cigarette paper.

In all the embodiments to be described, the inner core 102 and the outer jacket 104 consist of tobacco, flavour and casing materials of different taste.

The coaxial filter element 111 has a filter core 112 comprising a preferably air-impermeable wrapper 113. The diameter of the filter core 112 corresponds substantially to the diameter of the inner core 102 of the rod portion 101. A filter jacket 114 having a diameter corresponding to the diameter of the outer jacket 104 of the rod portion 101 coaxially surrounds the filter core 112 and its wrapper 113. The filter jacket 114 comprises an air-impermeable wrapper 115 serving also to connect the rod portion 101 and the filter element 111, and has a ventilation zone 116 for the filter jacket 114. Generally, the wrapper 115 is referred to as "tipping paper" or "connecting sheets". Below it, there is normally the filter wrapper paper or, briefly designated, the "filter wrapper". For simplicity, hereinafter reference will be made only to the "wrapper" of the filter jacket 114.

The filter jacket 114 is connected by the air-impermeable wrapper 115 to the rod portion 101 in such a manner that between the filter-side end of the rod portion 101 and the tobacco-side end of the filter element 111 a cavity results which forms a smoke mixing zone 120.

In all the embodiments to be explained, the filter core 112 and the filter jacket 114 have different filter efficiencies, one of said two filter segments being highly effective in each case, that is having a retention degree of at least 70%, in particular at least 80%, preferably at least 90% and in the extreme case even 100%, whilst the other of the two filter segments is of low effectiveness, i.e. has a retention degree of less than 50%, preferably less than 40%. The empty volume of the rod portion 101 altogether, i.e. the inner core 102 and the outer jacket 104, is at least 40% and at most 80%, whilst the empty volume of the two parts of the coaxial filter element 111 is at least 80%, preferably at least 90%. These particulars apply to all the embodiments.

During smoking of this coaxial filter cigarette 100 the different smokes from the inner core 102 and the outer jacket 104 of the rod portion 101 are mixed in the smoke mixing zone 120. Part of the smoke components of the stream flowing mainly in the highly effective segment 112, 114 of the filter element 111 is admixed to the smoke flowing in the less effective segment 112, 114 of the filter element 111. By using different blend, flavour and casing components in the outer jacket 104 and the inner core 102 of the rod portion 111, different mixing degress of the two smokes can be implemented. The smoke mixture from the smoke mixing zone 120 thereafter flows through the coaxial filter element 111, thereby firstly being specifically locally filtered and secondly ventilation air added thereto through the ventilation zone 116 in the air-impermeable wrapper 115 for the filter jacket 114. The ventilation zone 116 is formed by a line of punctiform ventilation openings which extend over the periphery of the coaxial filter element 111. The coaxial rod portion 101 serves for smoke and/or vapour generation and has a length corresponding to the usual dimensions of conventional cigarettes.

The axial length of the smoke mixing zone 120 is at least 0.2 mm, preferably about 0.5 mm; the axial length should not exceed about 1 mm.

The axially sectioned coaxial filter cigarette illustrated in FIG. 2 is denoted by the general reference number 200. The other reference numerals, except for the first number 2 referring to the second embodiment, correspond to the reference numerals employed in FIG. 1. The embodiment illustrated in FIG. 2 has a rod portion 201 and a coaxial filter element 211. The inner core 202 of the rod portion 201 consists of a material, in particular tobacco material, which glows or smoulders substantially residue-free, having an air-impermeable or sparingly porous wrapper 203 for the inner core 202. The air-permeability of the wrapper 203 should not exceed 50 ISO units. An outer jacket 204 coaxially surrounds the inner core 202 and its wrapper 203, consists of a tobacco and/or non-tobacco material and is surrounded by an air-permeable wrapper 205.

The coaxial filter element 211 comprises a filter core 212 having an air-impermeable wrapper 213. A filter jacket 214 coaxially surrounds the filter core 212 and its wrapper 213. The diameter of the filter jacket 214 corresponds to the diameter of the outer jacket 204 of the rod portion 201. The filter jacket 214 comprises an air-impermeable wrapper 215 which also serves to join the rod portion 201 and the filter element 211. A ventilation zone 216 is provided in the air-impermeable wrapper 215 for the filter jacket 214. The wrapper 203 of the inner core 202 of the rod portion 201 comprises a perforation zone at its filter-side end. Due to this perforation zone, in said transition region a smoke mixing zone 220 is formed in which the smokes from the outer jacket 204 and the inner core 202 of the rod portion 201 can mix. The smoke mixing zone 220 can be formed by mechanical perforation or by laser perforation of the wrapper 203.

The smoke from the inner core 202 flows substantially directly into the filter core 212 of the coaxial filter 216; in the same manner, part, usually the major part, of the smoke from the outer jacket 204 flows directly into the filter jacket 214. Part of the components from the smoke of the outer jacket 204, that is in particular the volatile components, flow through the perforation zone in the wrapper 203 of the inner core 202 of the rod portion 201 into the inner core 202 and during smoking of the cigarette are mixed together in the smoke mixing zone 220 before they flow into the coaxial filter element 211, where they are specifically filtered.

In addition, ventilation air penetrates through the ventilation zone 216 into the filter and in the filter jacket 214 mixes with the smoke mixture from the smoke mixing zone 220. The ventilation zone 216 is formed primarily by punctiform ventilation openings which extend over the periphery of the coaxial filter element 211 through the otherwise air-impermeable wrapper 215.

The axially sectioned coaxial filter cigarette illustrated in FIG. 3 has the general reference numeral 400. The further reference numerals otherwise correspond to the reference numerals of FIG. 1, including the smoke mixing zone 420, in each case the first digit "1" simply being replaced by a "4", and consequently the individual parts will not be explained again.

With this third embodiment, the rod portion 401 can be displaced within defined markings (not shown) on the cigarette paper in the projecting edge of the wrapper 415, the gap between the filter side end of the rod portion 401 and the tobacco-side end of the coaxial filter element 411 and thus the smoke mixing zone 420 thereby being correspondingly enlarged or diminished. This makes it possible for the smoker to adjust a desired smoke admixture ratio by accordingly varying the axial length of the smoke mixing zone 420 and thus the "mixing section", i.e. the section along which the smoke streams from the two segments of the rod portion 401 can mix together.

FIG. 4 shows an axial cross-section through a coaxial filter cigarette which is indicated generally by the reference numeral 500. The reference numerals again correspond accordingly to the reference numerals of the preceding figures, except for the first digit. The cigarette according to this fourth embodiment consists of a coaxial rod portion 501 and a coaxial filter element 511. The rod portion comprises an inner core 502 of a material, in particular tobacco material, glowing substantially residue-free, having an air-impermeable or sparingly porous wrapper 503 for the inner core. The air permeability of the wrapper 503 is at the most 50 ISO units.

An outer jacket 504 of a tobacco and/non-tobacco material surrounds the inner core 502 and its wrapper 503. The outer jacket 504 is surrounded by an air-permeable wrapper 505.

The coaxial filter element 511 comprises a filter core 512 having an air-impermeable wrapper 513. A filter jacket 514 coaxially surrounds the filter core 512 and its wrapper 513. The diameter of the filter jacket 514 corresponds to the diameter of the outer jacket 504 of the rod portion 501. The filter jacket 514 comprises an air-impermeable wrapper 515 also serving to connect the rod portion 501 and coaxial filter element 511. A ventilation zone 516 is located in the air-impermeable wrapper 515 for the filter jacket 514.

In the wrapper 505 for the outer jacket 504 and the filter-side end of the rod portion 501 there is a ventilation zone which is made electrostatically or by means of laser. The adjustment of the ventilation and thus of the smoke mixture can be effected in two ways:

In the first case, a rotatable ring 507 having perforations section-wise in the radial direction surrounds the coaxial filter element 511 and the rod portion 501. The ventilation zone 506 of the rod portion 501 likewise has perforations in the radial direction only in sections. By rotating the ring 507 the ventilation zone 508 of the ring 507 and the ventilation zone 506 of the rod portion come into coincidence and thus permit a ventilation of the tobacco rod preferably in the range of 20–50% degree of ventilation.

In the second case a ring 507 displaceable in the axial direction over the ventilation zone of the rod portion 501 surrounds the outer jacket 515 of the filter element 511. As a result, the ventilation zone 506 of the rod portion 501 can be partially or entirely covered, thereby enabling the smoker to adjust the ventilation ratio.

A smoke mixing zone 520 is located in the tobacco-side portion of the filter core 512, mixing taking place here of the smokes of the outer jacket 504 and of the inner core 502 of the rod portion 501 in the filter core 512.

By the ventilation zone 516 on the one hand and the variable ventilation zone at the filter-side end of the rod portion 501 on the other, the two smoke streams coming from the rod portion 501 can be influenced and by varying the ventilation in the manner explained also adjusted so that an admixing of the smoke from one rod segment to the smoke from the other segment takes place in dependence upon the ventilation degree set. The ratio of the two smoke streams is "out of balance" and the smoke equilibrium changes, thereby enabling certain flavour nuances to be obtained.

I claim:

1. A coaxial filter cigarette comprising

A) a coaxial rod portion having a) an inner core of a tobacco material smouldering substantially residue-free, b) a wrapper for the inner core, c) an outer jacket consisting of a tobacco material and coaxially surrounding the inner core and its wrapper, d) and an air-permeable wrapper for the outer jacket;

B) a coaxial filter element having a) a filter core having an air-impermeable wrapper, b) a filter jacket coaxially surrounding the filter core and its wrapper and having a diameter corresponding to the diameter of the outer jacket, c) an air-impermeable wrapper for the filter jacket serving also to connect the rod portion and the filter element, and d) a ventilation zone in the air-impermeable wrapper for the filter jacket;

wherein:

C) a smoke mixing zone is formed between the rod portion and the filter element for defined variation of the smoke streams leaving the rod portion before the smoke streams flow into the filter element.

2. A coaxial filter cigarette according to claim 1, wherein the smoke mixing zone is formed in that the rod portion is arranged with its filter-side end spaced from the tobacco-side end of the co-axial filter element, a cavity thereby being formed which is surrounded by the air-impermeable wrapper of the filter jacket.

3. A coaxial filter cigarette according to claim 1, wherein the smoke mixing zone is formed in that the wrapper of the inner core of the rod portion is provided with a perforation zone in the region of its filter-side end.

4. A coaxial filter cigarette according to claim 1, wherein an empty volume proportion of the rod portion lies in the range between about 40% and about 80%.

5. A coaxial filter cigarette according to claim 1, wherein an empty volume proportion of the filter element is at least 80%, preferably more than 90%.

6. A coaxial filter cigarette according to claim 1, further comprising predefined markings on the wrapper of the outer jacket in the axial direction in a projecting edge region of the wrapper of the filter element, wherein the rod portion is arranged with its filter-side end spaced from the tobacco-side end of the filter element, and is displaceable with said predefined markings.

7. A coaxial filter cigarette according to claim 1, further comprising a displaceable ring, wherein the wrapper of the outer jacket of the rod portion comprises a perforation zone which is at least partially coverable by the ring, said ring being displaceable on the outer surface of the coaxial filter cigarette and having corresponding perforations, so that by varying the ventilations the smoke streams can be influenced and thus an admixing of a smoke stream to another takes place.

8. A coaxial filter cigarette according to claim 7, wherein the ring is arranged displaceably or rotatably on the outer periphery of the coaxial filter cigarette.

9. A coaxial cigarette according to claim 1, wherein an empty volume proportion of the filter element is more than 90%.

* * * * *